US010487501B2

(12) United States Patent
Howorth et al.

(10) Patent No.: US 10,487,501 B2
(45) Date of Patent: Nov. 26, 2019

(54) FORMWORK SYSTEM

(71) Applicant: TWINWALL ICF LIMITED, Abbas (GB)

(72) Inventors: Graeme Cedric Howorth, Somerset (GB); Malcolm Charles Howorth, Dorset (GB)

( * ) Notice: Subject to any disclaimer, the term of this patent is extended or adjusted under 35 U.S.C. 154(b) by 41 days.

(21) Appl. No.: 15/519,766

(22) PCT Filed: Oct. 15, 2014

(86) PCT No.: PCT/GB2014/000417

§ 371 (c)(1),
(2) Date: Apr. 17, 2017

(87) PCT Pub. No.: WO2016/059357

PCT Pub. Date: Apr. 21, 2016

(65) Prior Publication Data

US 2017/0254072 A1 Sep. 7, 2017

(51) Int. Cl.
*E04B 2/86* (2006.01)
*E04G 17/06* (2006.01)
(Continued)

(52) U.S. Cl.
CPC ..... *E04B 2/8641* (2013.01); *B28B 7/303* (2013.01); *B28B 7/306* (2013.01); *E04B 2/86* (2013.01);
(Continued)

(58) Field of Classification Search
CPC ..... E04B 2/8617; E04B 2/8647; E04B 2002/8694; E04B 1/6129; E04B 2/8652;
(Continued)

(56) References Cited

U.S. PATENT DOCUMENTS 855,219 A * 5/1907 Anthony, Jr. ..... A21C 15/002 118/502
874,151 A * 12/1907 Zeiser ..... B25B 1/2478 249/210
(Continued)

FOREIGN PATENT DOCUMENTS

DE 2538246 10/1976
DE 29702609 4/1997
(Continued)

OTHER PUBLICATIONS

Machine Translation of Japanese Patent JP 2006307604 A (obtained from the European Patent Office at https://worldwide.espacenet.com/singleLineSearch?locale=en_EP) (Year: 2018).*
(Continued)

*Primary Examiner* — Joshua J Michener
*Assistant Examiner* — Charissa Ahmad

(57) ABSTRACT

The present invention provides a system 10 for construction of formwork where a settable compound is pourable into a cavity in the formwork and retained by the formwork to set to form a completed structure. The formwork comprises structural panels 12, 14 connected by adjustable connectors 34 for varying the spacing between the panels.

16 Claims, 5 Drawing Sheets

(51) Int. Cl.

| | |
|---|---|
| ***B28B 7/30*** | (2006.01) |
| ***E04C 5/16*** | (2006.01) |
| *B28B 7/28* | (2006.01) |
| *E04B 2/84* | (2006.01) |

(52) U.S. Cl.
CPC ..... *E04B 2/8617* (2013.01); *E04C 5/168* (2013.01); *B28B 7/28* (2013.01); *E04B 2/84* (2013.01); *E04B 2/8635* (2013.01); *E04B 2002/8694* (2013.01); *E04G 17/06* (2013.01)

(58) Field of Classification Search
CPC ..... E04B 2/8635; E04C 5/168; E04G 17/14; E04G 17/06; E04G 17/0638; E04G 17/0658; E04G 17/0758
See application file for complete search history.

(56) References Cited

U.S. PATENT DOCUMENTS 1,191,492 A * 7/1916 Becker ..... E04G 17/06 249/115
1,214,829 A * 2/1917 Ross ..... E04G 17/0658 249/190
1,345,156 A * 6/1920 Flynn ..... E04B 2/8641 29/433
1,451,457 A * 4/1923 Buchenau ..... E04G 17/0658 249/218
1,609,912 A * 12/1926 Mazeau ..... G01C 5/00 33/1 H
1,622,072 A * 3/1927 Watson ..... E04G 17/14 249/22
1,682,740 A * 9/1928 Colt ..... E04G 17/0742 249/219.1
1,700,889 A * 2/1929 Heltzel ..... E01C 23/021 249/4
2,400,852 A * 5/1946 Stevenson ..... E04G 17/12 249/194
2,453,434 A * 11/1948 Harder ..... E04G 17/0742 29/509
2,849,745 A * 9/1958 Madsen ..... A47L 4/04 134/135
2,930,096 A * 3/1960 Haber ..... E04G 17/0658 249/216
2,937,485 A * 5/1960 Wall ..... B65B 5/06 414/789.1
3,014,321 A * 12/1961 Lesch ..... B65B 5/06 198/465.1
3,222,095 A * 12/1965 Gerus ..... A47B 91/02 403/104
3,625,470 A * 12/1971 Shoemaker ..... E04G 17/0721 249/214
3,690,613 A * 9/1972 Shoemaker ..... E04G 17/0721 249/40
3,985,329 A * 10/1976 Liedgens ..... E04B 2/8647 249/40
4,066,237 A 1/1978 Bentz
4,192,481 A * 3/1980 Durbin ..... E04G 11/12 249/191
4,339,106 A * 7/1982 Navarro ..... E04G 17/12 249/219.1
4,765,109 A * 8/1988 Boeshart ..... E04B 2/8641 52/426
4,884,382 A * 12/1989 Horobin ..... E04B 2/8641 52/426
4,889,310 A * 12/1989 Boeshart ..... E04B 2/8641 249/41
4,915,345 A * 4/1990 Lehmann ..... E04G 11/062 249/10
5,058,854 A * 10/1991 Bravo ..... B28B 23/0056 249/2
5,065,561 A * 11/1991 Mason ..... E04B 2/8641 52/309.12
5,219,473 A * 6/1993 Sandwith ..... B28B 7/0014 249/155
5,390,459 A * 2/1995 Mensen ..... E04B 2/8617 52/424
5,419,055 A * 5/1995 Meadows ..... E04G 21/1808 249/219.1
5,735,093 A * 4/1998 Grutsch ..... E04B 2/8635 52/309.11
5,896,714 A * 4/1999 Cymbala ..... E04B 2/8617 52/426
6,705,583 B2 * 3/2004 Daniels ..... E04G 13/00 249/216
7,108,144 B2 * 9/2006 Goodwin ..... B05B 13/0285 118/500
7,275,731 B1 * 10/2007 Shinault ..... E04G 17/06 248/354.5
7,827,752 B2 * 11/2010 Scherrer ..... E04B 2/8641 52/309.12
7,841,576 B2 * 11/2010 Miller ..... E01C 19/502 249/208
8,261,509 B2 * 9/2012 Harkin ..... E04G 23/0237 52/645
8,348,222 B2 * 1/2013 Lin ..... E04G 17/0658 249/42
8,443,560 B2 * 5/2013 Uhl ..... E04B 2/8635 52/220.1
2002/0162294 A1 * 11/2002 Beliveau ..... E04B 2/8617 52/578
2003/0029130 A1 * 2/2003 Humphrey ..... E04G 13/00 52/742.1
2003/0213198 A1 * 11/2003 Bentley ..... E04B 2/8617 52/415
2004/0129857 A1 * 7/2004 Musk ..... E04G 17/047 249/43
2005/0028467 A1 * 2/2005 Bentley ..... E04B 2/8617 52/474
2005/0108963 A1 * 5/2005 Wostal ..... E04B 2/8617 52/426
2007/0094974 A1 * 5/2007 Velickovic ..... E04B 2/8652 52/426
2009/0057530 A1 * 3/2009 Sheckter ..... E04B 2/8647 249/18
2009/0249725 A1 * 10/2009 McDonagh ..... E04G 11/085 52/378
2009/0256055 A1 * 10/2009 Foser ..... E04G 17/064 249/190
2014/0007537 A1 * 1/2014 Quiles Perez ..... E04B 2/8635 52/426
2014/0259990 A1 * 9/2014 Pfeiffer ..... B28B 7/02 52/127.7
2014/0260055 A1 * 9/2014 Pfeiffer ..... E04G 17/12 52/582.1
2017/0121988 A1 * 5/2017 McDonagh ..... E04G 17/0758
2017/0321419 A1 * 11/2017 Stewart ..... E04B 2/8635

FOREIGN PATENT DOCUMENTS

EP 52455 A * 5/1982
FR 2998314 A1 * 5/2014 ..... E04B 2/8617
FR 3030590 A1 * 6/2016 ..... E04B 2/8652
JP 2006-112090 4/2006
JP 2006307604 A * 11/2006
JP 2011117241 A * 6/2011
WO 99/11883 3/1999
WO 01/59227 8/2001
WO 2005/124046 12/2005
WO WO-2009127937 A2 * 10/2009 ..... E04B 2/8617
WO WO 2011131838 A1 * 10/2011
WO 2011/138573 11/2011
WO WO-2014138841 A1 * 9/2014 ..... E04B 2/8635

OTHER PUBLICATIONS

International Search Report with Written Opinion dated Jun. 11, 2016 in International Application No. PCT/GB2014/000417.

(56) References Cited

OTHER PUBLICATIONS

Combined Search and Examination Report dated Mar. 7, 2016 in United Kingdom Patent Application No. 1516653.1.

* cited by examiner

FORMWORK SYSTEM

FIELD OF THE INVENTION

The present invention relates to a system for construction of formwork where a settable compound is pourable into a cavity in the formwork and retained by the formwork to set to form a completed structure

BACKGROUND OF THE INVENTION

Systems for construction of formwork are known hereto and an earlier known example is disclosed in WO2011/138573 (SIFTEK). The earlier patent application shows a system having structural panels connected by connectors to define a cavity therebetween for receiving a settable compound such as concrete.

German Patent Application DE-A-19904431 (Schuller) describes an adjustable length spacer with a scissor arrangement.

Other prior art is disclosed in U.S. Pat. No. 4,765,109 (Boeshart) which shows an adjustable tie includes a pair of straps selectively connected together to form a single tie. Each of the pair of straps has a pair of spaced-apart plates at the outer end which will hold the panel of a wall form therebetween. Slots cut in the panels allow the tie ends to be inserted in the panels. The pair of straps which form each tie are identical, and have a series of pegs and apertures which are cooperable in selected positions to vary the length of the tie. In a second embodiment, the portion of each strap between the inner and outer plates is comprised of two interconnecting pieces so that the distance between the plates is adjustable, to allow for various panel thicknesses.

German Utility Model DE-U1-29618158 (Rausch) discloses telescoping pieces for use in a formwork.

U.S. Pat. No. 6,321,498 (Trovato) discloses a formwork for building walls comprising: a first facing panel and a first insulating layer and a plurality of parallel spacing members disposed therebetween. The parallel spacing members cooperate with a first facing layer and the first insulating layer to form horizontal and vertical channels in communication with each other between the first facing layer and the first insulating layer. A second facing panel has a similar structure. The first and second facing panels define a space therebetween and braces remain in situ when a cementitious material is poured in the space and solidifies.

Other examples of formwork construction systems are disclosed in Japanese Patent Application JP-A-2006112090 (Saihara Tadashi) and International Patent Application number WO-A-01/59227 (Polyform AGP Inc).

A problem which has existed was that associated with the storage and transportation of these formworks prior to deployment at a building site. Due to their nature a large percentage of the volume has been occupied by a space between the panels and this resulted in costly transportation.

The present invention arose in order to provide a formwork which could be stored in a compact form, for example transportation, and transformed quickly and easily, in a safe a reliable manner, to an open form when required and prior to assembly.

Another object of the invention was to provide a formwork that can be deployed into one of several different inter-panel spacing sizes for use in different applications and without the need to fabricate several different sizes.

SUMMARY OF INVENTION

According to a first aspect of the present invention, there is provided a formwork system for construction comprising:

structural panels and a plurality of connectors which when adjusted define a formwork for receiving a settable compound in a cavity defined by the structural panels, the system comprising: first and second structural panels which in use are connected one to another by the connectors so as to define the cavity, the first and second structural panels have respective first and second panel connection formations formed therein for connection to the connectors; a plurality of connectors each have first and second end connecting portions adapted for connection to the respective first and second panel connection formations so as to hold the first and second panels parallel one to another; and the plurality of connectors each further having an adjustable portion that adjusts the connected distance between the first and second structural panels; wherein the system is arranged so that the panels can be locked in a plurality of relative positions by means of the adjustable portion between the two extremes of movement and at one or more relative positions between the extremes, namely a reduced connected distance and an increased connected distance; and wherein the reduced connected distance is selected such that the structural panels sit generally flush against one another so that there is substantially no space between the panels.

Thus the present invention relates to a system having structural panels that can be arranged parallel to one another and connected one to another by means of connectors. The connectors can be adjusted between a plurality of positions so that the distances between the structural panels can be varied between a reduced connected distance and an increased connected distance. In the position corresponding to the reduced connected distance, the distance between the structural panels is essentially zero such that the structural panels sit flush against one another. This is particularly beneficial during transport of the system, as this reduces the space between the structural panels to a minimum. Thus the stowage volume required is reduced compared to similar prior art formwork systems.

The first and second panel connection formations may be fixed to respective first and second end connecting portions of the connectors during manufacture by forming the connection formations around the end connecting portions.

The first and second panel connection formations may be fixed to respective first and second end connecting portions of the connectors by moulding the connection formations around the connectors.

The adjustable portion of the connectors are ideally lengthwise adjustable and a tool may be provided for this or adjustment may be achieved manually.

The adjustable portion of the connectors may comprise a plurality of sliding members which fit within one another in a telescoping arrangement for increasing or decreasing the length of the adjustable portion.

The first and second end connecting portions may comprise sockets for receiving by sliding fit the adjusting portion in a telescoping arrangement for increasing or decreasing the spacing between the structural panels.

The, or each, sliding member of the adjusting portion is preferably sized to be received substantially fully within the end connecting portions of the connectors. In a preferred embodiment a connecting sliding member is substantially plate like in form and has recesses cut or formed therein in order to support a reinforcement bar at predefined locations thereby providing a framework for crosspieces and thus considerably adding to the strength and integrity of a finished structure.

A locking mechanism may be operable for resisting lengthwise extension of the adjustable portion.

The locking mechanism may comprise a plurality of locking pins for abutting against the sliding member or members of the adjusting portion for limiting relative sliding movement.

The locking mechanism may be selectively operable for resisting lengthwise extension of the adjustable portion beyond any one of a plurality of lengths.

The connecting portions of the connectors may be configured to engage with the panels connection formations of the structural panels over the length or height of the structural panels when the structural panels are in use The system may have a transportation state in which the adjustable portions of the connectors are adjusted to minimise the spacing between the structural panels and a formwork state in which the adjustable portions are adjusted to space the structural panels apart from one another for defining the cavity for receiving a settable compound.

According to another aspect of the invention there is provided a plurality of connectors for use with a formwork construction system, the connectors are adapted for use with first and second structural panels, so that when installed therein, the connectors permit adjustment of the panels from a closed position to an open position thereby defining a cavity between the structural panels for receiving a settable compound, the connectors comprising: first and second end connecting portions adapted for connection to respective first and second panel connection formations that are formed in the panels for receiving the first and second end connecting portions; and a third adjustable portion which has two ends each of which connects to the first and second end connecting portions respectively, so that in use adjustment of the distance between the first and second end connecting portions is permitted; and a lock mechanism enables the first and second end connecting portions and the third adjustable portion, to be locked in a plurality of relative positions.

The first and second end connecting portions are ideally formed as sockets for receiving, by way of a slide fit the third adjustable portion in a telescoping manner, thereby in use permitting the spacing between the structural panels to be increased or decreased.

It is understood that end connecting portions and adjustable members, together with the locking mechanism may be supplied in a sealed package for deployment with panels supplied and delivered separately to a construction site.

BRIEF DESCRIPTION OF THE DRAWINGS

In order that the invention may be well understood, several embodiments thereof, which are given by way of example only, will now be described with reference to the accompanying drawings, in which.

DETAILED DESCRIPTION OF AN EMBODIMENT OF THE INVENTION

A system for construction of formwork is shown in the Figures where a settable compound is pourable into a cavity in the formwork and retained by the formwork to set to form a completed structure.

Figure 1:
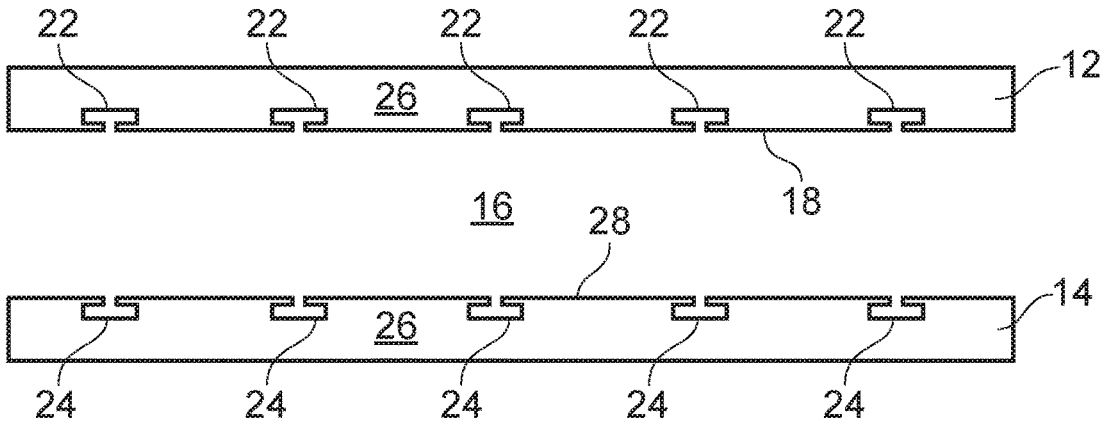
FIG. 1 shows a plane view of first and second structural panels of a formwork system.
Figure 2:
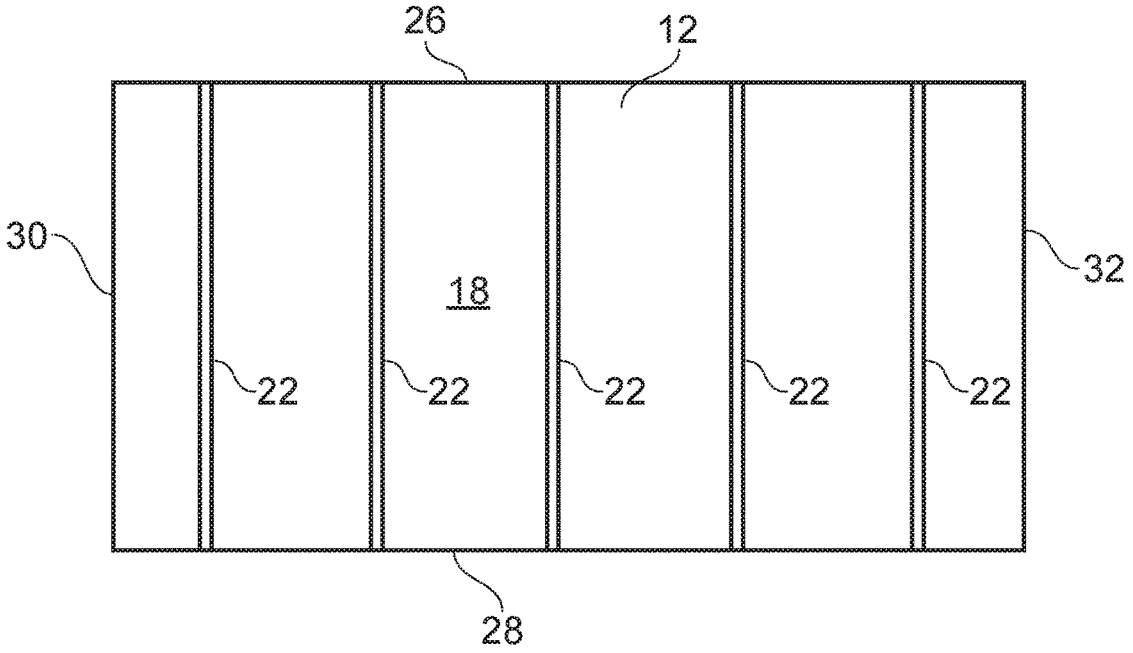
FIG. 2 shows the first structural panel in elevation.

Referring to FIGS. 1 and 2, the system comprises first and second structural panels 12, 14 arranged to be connected together by connectors (shown in FIGS. 3 to 9) for forming a cavity 16 between the panels. When the panels are fixed in relative orientation, a settable compound such as concrete can be poured into the cavity and allowed to cure. When cured, the panels can be removed or left in place to provide insulation or finished surfaces.

The panels in the illustrations are configured for forming a wall of, for example, a residential or commercial building, although the panels may have alternative configurations for forming other structures, such as walls having an aperture for a window or doorway or foundations. In the present example, the structural panels 12, 14 are generally planar and have planar inner surfaces 18, 28 which define the cavity 16, as shown in the plan view of both panels in FIG. 1 and as shown in the elevation of the first panel in FIG. 2. When in use and on-site, the panels are arranging in a generally vertical orientation and have upper and lower surfaces 26, 28 and lateral surfaces 30, 32. The height of the panels between the upper and lower surfaces and the width between the lateral surfaces is selected dependent on the structure that is required.

The first structural panel 12 has first panel connection formations 22 for connecting to one end portion of respective connectors. The second structural panel 14 has second panel connection formations 24 for connecting to the other end of the respective connectors. The first and second panel connection formations 22, 24 each extend generally in the plane of the panels and across the height of the structural panels between upper and lower surfaces 26, 28. Optionally slots may be formed subsequently so as to allow for the web to be used both in a moulded form and also where the formwork or formwork panels have slots formed therein.

In an alternative arrangement, the connections formations may extend across the width of the structural panels between lateral surfaces 30, 32. The arrangement whereby the formations extend substantially across the full extent of the structural panels efficiently distributes loading generated when the panels are in use. In a modified arrangement, the connection formations do not extend across the full extent of the panels and instead may be provided at a plurality of discrete spaced apart locations.

Figure 3:
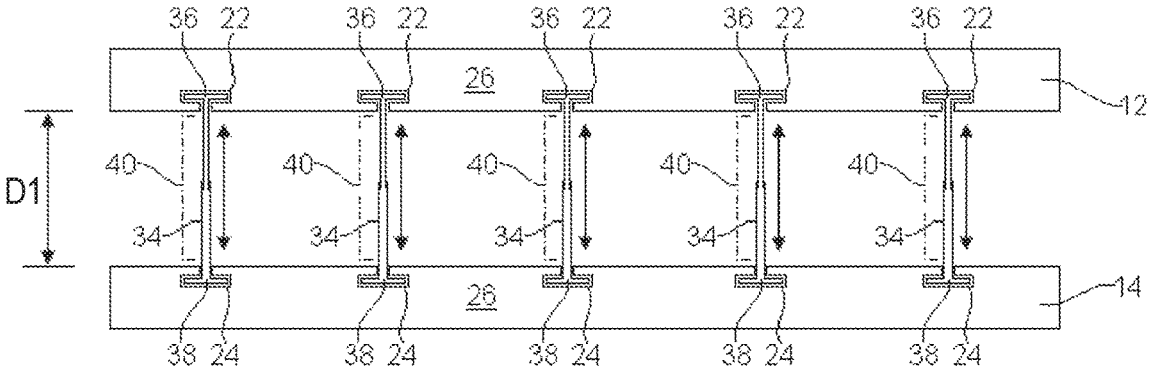
FIGS. 3 and 4 show the first and second structural panels connected by connectors and illustrate diagrammatically how variation in the spacing between the panels is achieved.
Figure 4:
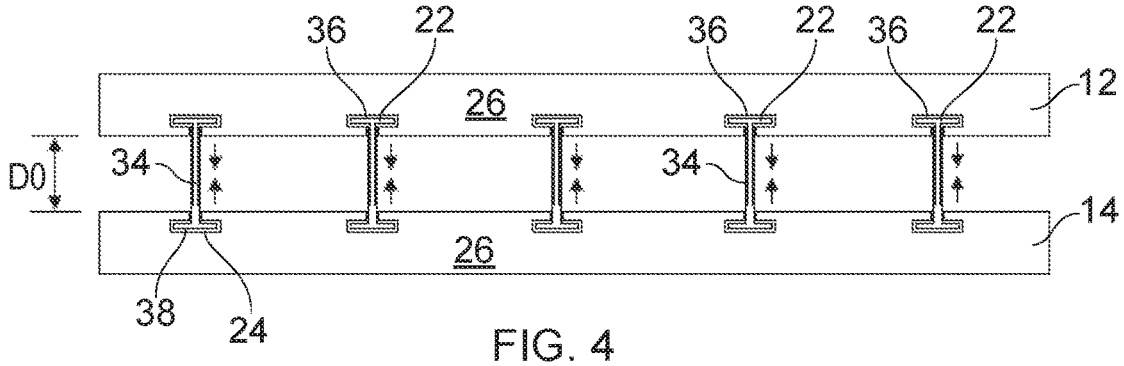

Referring to FIGS. 3 and 4, the structural panels 12, 14 are connected together by a plurality of connectors 34. Each connector 34 has a first end connecting portion 36 adapted for connection to the first panel connection formation 22 and a second end connecting portion 38 adapted for connection to the second panel connection formation 24. An adjustable portion 40 of the connectors 34 is configured for adjusting the connected distance D0 and D1 between the first and second structural panels. Connection of the connectors holds the first and second structural panels substantially parallel to one another and the spacing between the first and second structural panels is variable by adjustment of the adjustable portion of the connectors.

FIG. 4 shows a state of the connectors 34 in which the connected distance D0 is reduced, for example to allow the system to be transported whilst occupying a reduced amount of space. FIG. 3 shows a state of the connectors in which the connected distance D1 is increased to define the cavity 16 and for receiving a settable compound for forming a structure. The reduced connected distance D1 may be such that the structural panels 12, 14 sit flush against one another so that there is substantially no space between the panels.

The system may be arranged so that the connectors can be adjusted between connected distances D0 and D1 and locked in either condition by locking members (not shown). The system may be arranged so that panels can be locked in any one of a plurality of relative positions either at the two extremes of movement or additionally at one or more relative positions between the extremes. If the system is arranged specifically for reduction of space when the system is transported it is sufficient that the system is adjustable between one reduced and one expanded condition. However, in other examples the system may be adjustable between a plurality of in use conditions for adjusting the space between the panels for defining the cavity.

As shown in FIGS. 3 and 4 the adjustable portion of the connectors is lengthwise adjustable and comprises a telescoping arrangement wherein one part of the adjustable portion fits within another part of the connected portion for sliding movement between the conditions shown in FIGS. 3 and 4. In modifications, the length of the adjustable portion of the connectors or the space between the panels can be adjusted by other means.

Other means for adjusting the spacing between the panels may be provided depending on requirements.

Referring to FIGS. 3 and 4, the panel connection formations 22, 24 are shaped to correspond with the shape of the respective connecting portions 36, 38 of the connectors 34. In the illustration, the connection formations 22, 24 comprise T-shaped sockets arranged to receive T-shaped connecting portions 36, 38. As shown the sockets open into the upper surface 26 of the structural panels 12, 14 so that the T-shaped connecting portions can be slid along the sockets to connect the connectors with the panels.

The connection formations of the structural panels and the connecting portions of the connectors may take any alternative other configurations. The system may be arranged as illustrated whereby the connectors can be connected and disconnected from the panels, but in an alternative the connectors may be fixed to the panels during manufacturing and not removable.

In this preferred arrangement, the first and second panel connection formations are fixed to respective first and second end connecting portions of the connectors during manufacture by forming the connection formations around the end connecting portions. In the case where the panels are made from a synthetic plastics material, such as thermoplastic polymer, the panel connection formations may beneficially be formed by moulding the connection formations around the connectors. Insert moulding may be used whereby at least the end connecting portions of the connectors are inserted into a tool for moulding the panels.

When the synthetic plastics material or thermoplastic polymer is introduced to the tool, the panels are formed around the end connecting portions of the connectors so that they are fixed together. When moulded each panel comprises a plurality of end connecting portions. The panels can subsequently be connected together by insertion of the adjustable portion of the connectors into the end connecting portions. Alternatively, both panels may be moulded together with end connecting portions of the connectors inserted in the tool for forming both panels. In this case, the system is moulded with the connectors in place. Typically, once moulded the adjustable portion of the connectors is reduced in length so that the spacing between the panels is minimized for storing or transporting the system.

A further embodiment of the connectors will now be described in more detail with reference to FIGS. 5 to 9.

Figure 8:
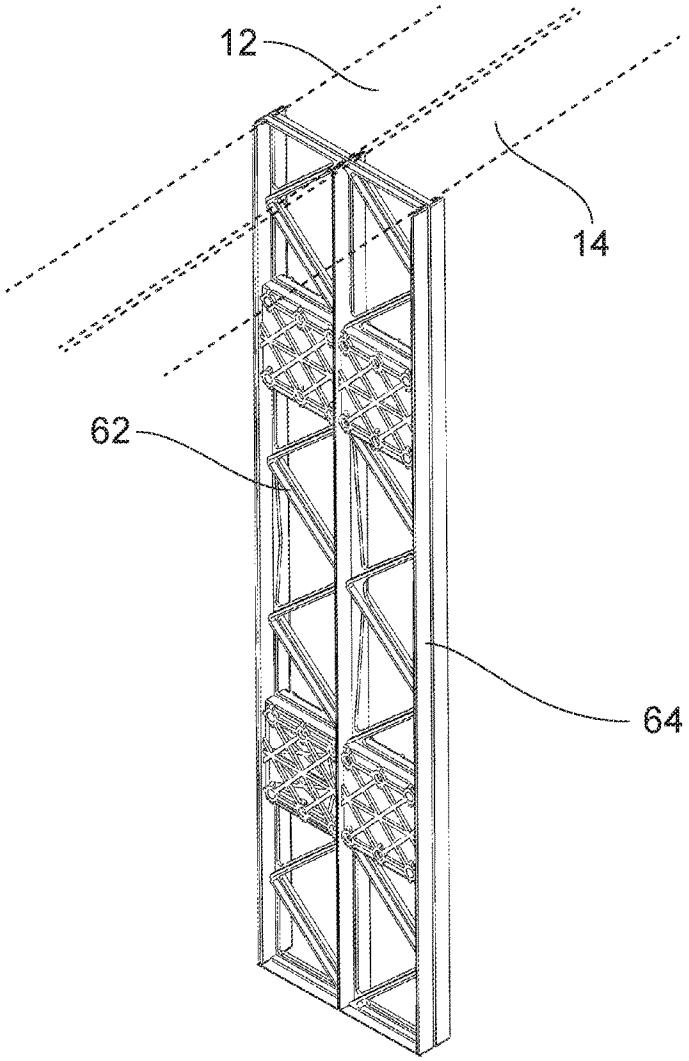
Figure 9:
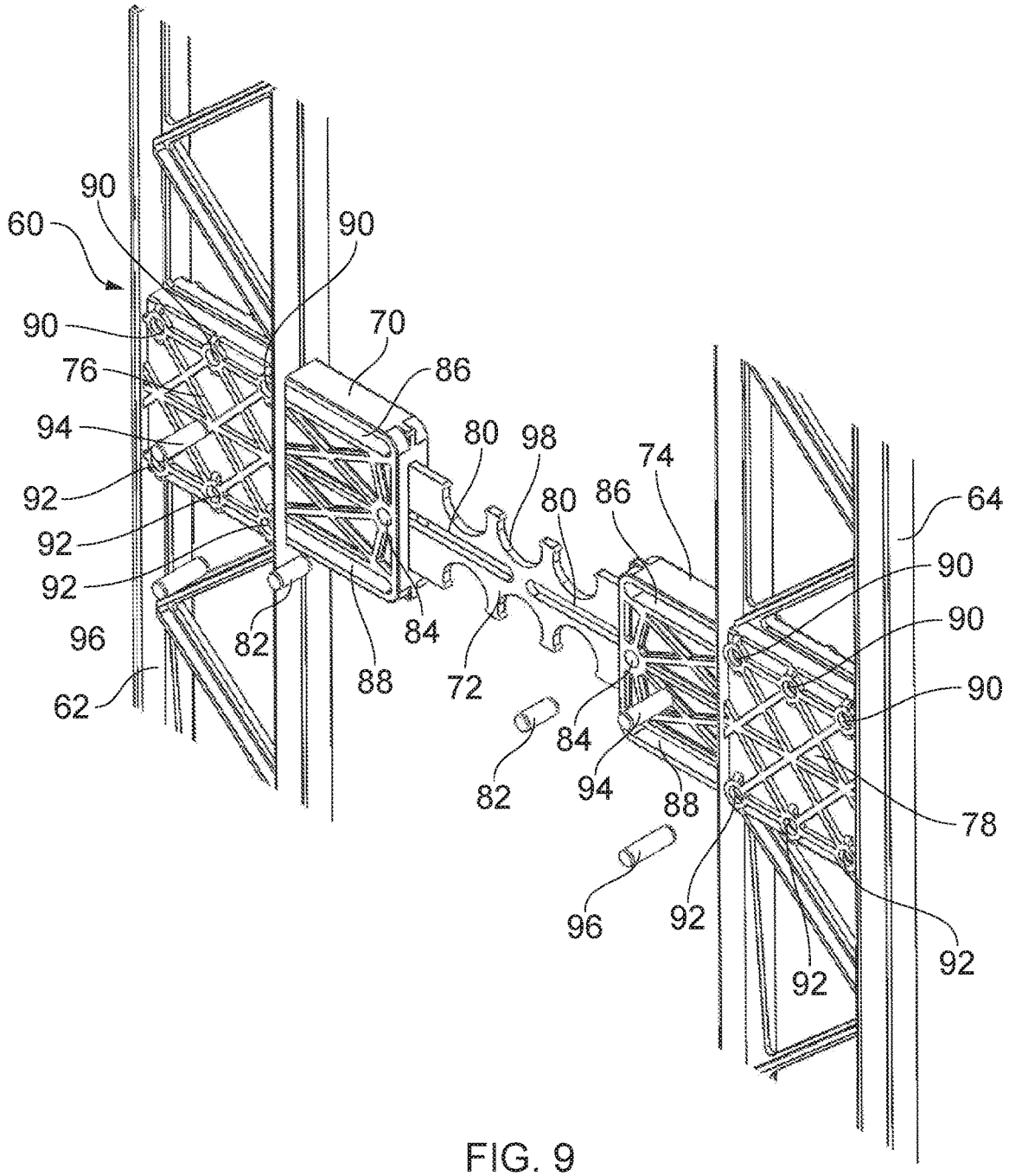
FIG. 9 shows the connector of FIGS. 5 to 8 in more detail with a locking mechanism.

A connector 60 is shown in FIG. 9 for connecting first and second structural panels 12, 14. Only one connector is shown in this example although a plurality of connectors 60 are provided in the formwork system, as shown in FIGS. 3 and 4 although as the connectors are generally the same only one such connector is shown in FIGS. 5 to 9.

The connectors 60 comprises a first connecting portion 62 for connection to the first structural panel 12 and a second connecting portion 64 for connection to the second structural panel 14. Each of the connecting portions 62, 64 comprises a flange member having an I-shaped profile 66, 68. The I-shaped profile has two flanges and a web connecting the flanges. The outer flange and web are shaped to engage with a T-shaped socket of the first and second structural panels, as shown in more detail in the previous drawings. The inner flange is configured to sit generally flush against the inner surface of the structural panels. The connecting portions may be insert moulded in the structural panels.

The connectors 60 comprises in the illustration two adjustable portions, each comprising first, second and third sliding members 70, 72, 74. There may be any number of adjustable portions depending on the size of the structural panels and anticipated loading. In the case of each adjustable portion, the second sliding member 72 is fitted in the first and third sliding members 70, 74 for relative sliding movement in a dimension extending generally perpendicularly to the plane of the structural panels 12, 14, as indicated by the double headed arrows.

The first and third sliding members 70, 74 are fitted in respective sockets 76, 78 of the flanged members 62, 64 for relative sliding movement in the dimension shown by the double headed arrows. Accordingly, the sockets 76, 78 and the first, second and third sliding members 70, 72, 74 have a telescoping arrangement for increasing or decreasing the distance between the flanged members 62, 64 and therefore the spacing between the first and second structural panels 12, 14 when the connectors 60 are fitted in place.

Figure 6:
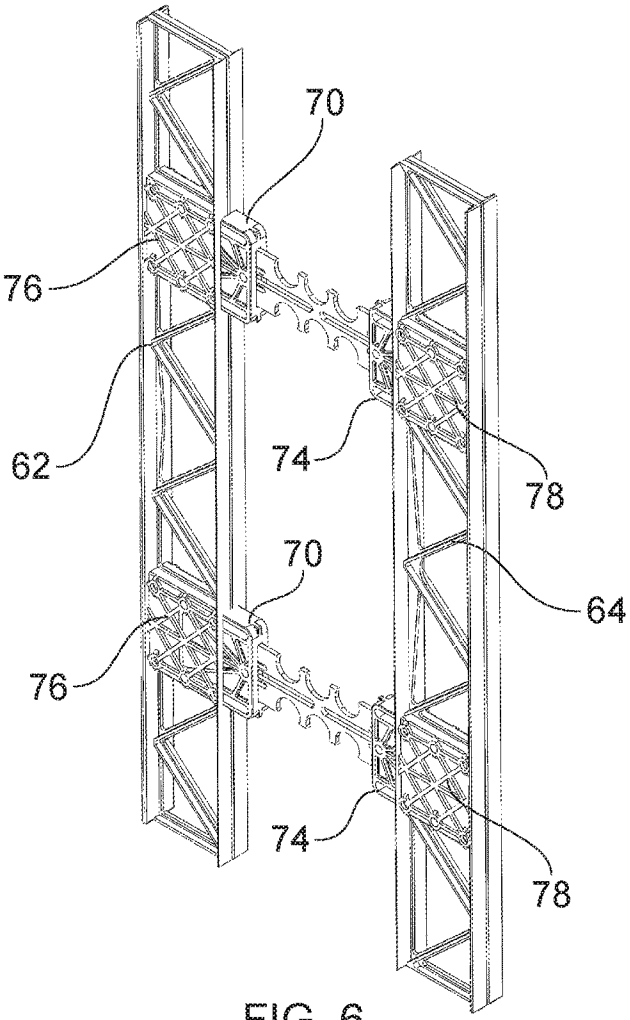
FIGS. 5 to 8 show a connector for connecting together structural panels in different stages of contraction and extension.
Figure 5:
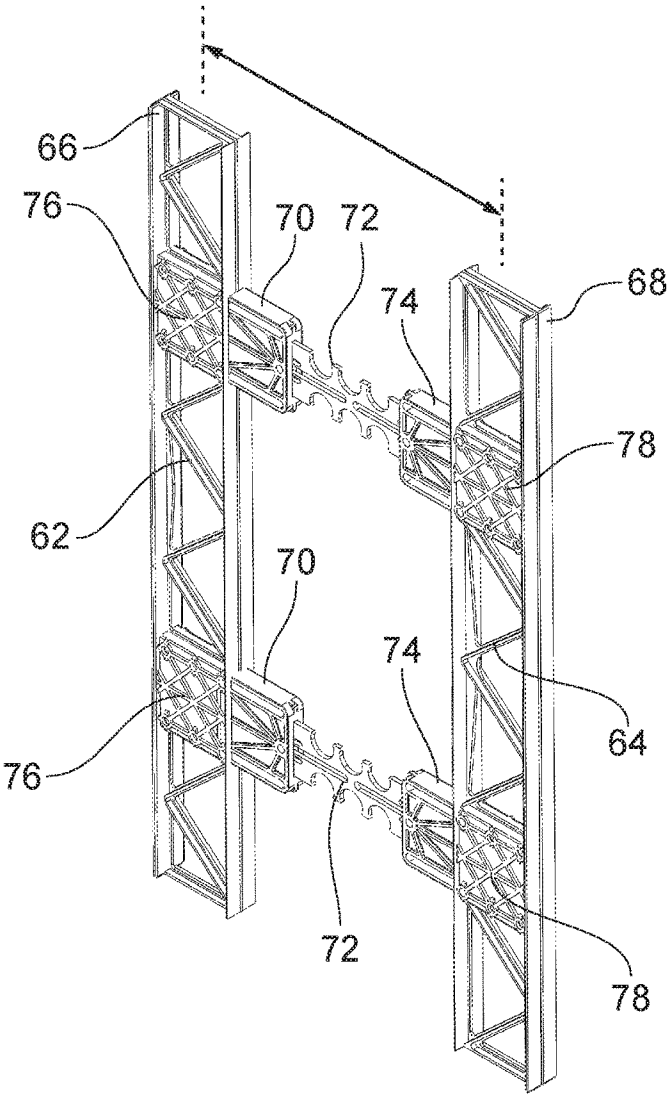
Figure 7:
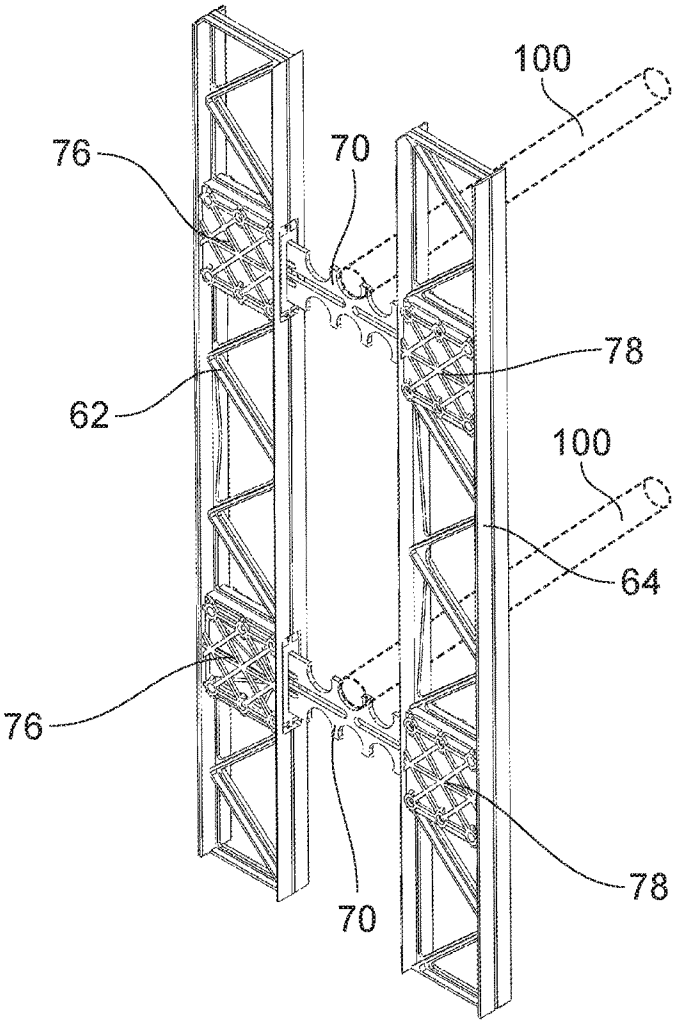

FIG. 5 shows a connector 60 in the expanded condition suitable for use on site, the structural panels being spaced apart to define the cavity 16 for receiving a settable compound. FIGS. 6 and 7 show the connector 60 as the distance between the flanged members 62, 64 is decreased. FIG. 8 shows the connector 60 with little or no distance between the flanged members. In this condition, the flanged members are adjacent and there is minimal spacing between the structural panels.

Referring to FIG. 6, the first and third sliding members 70, 74 are shown partially received in sockets 76, 78. FIG. 7 shows the first and third sliding members fully or predominantly received in the sockets. As illustrated, the spacing between the flanged members 62, 64 is gradually reduced by sliding the sliding members 70, 74 into the sockets 76, 78. FIG. 8 shows the second sliding member 72 fully received in the first and second sliding members 70, 74.

Sliding the members 72 into the members 70, 74 further decreases the spacing between the flanged members 62, 64. The contraction step shown in FIG. 8 may be carried out prior to or during the contraction shown in FIGS. 6 and 7.

FIG. 8 shows in broken lines the location of the structural panels 12, 14 which following contraction of the connectors are in close proximity with minimal spacing therebetween. The lengths of the sliding members 70, 72, 74 and the sockets 76, 78 are selected to minimise the spacing between the structural panels. Referring to FIG. 5, the sliding members 70, 74 have a length in the dimension indicated by the double headed arrows which is less than or equal to that of the sockets 76, 78 in that dimension so that the sliding members can be fully received in the sockets.

The length of the sliding member 72 has a length in the dimension which is less than or equal to the length of both the sliding members 70, 74 (and both the sockets 76, 78) so that the sliding member 72 can be fully received in sliding members 70, 74 (and in the sockets). Additionally the length by which the flanged members 62, 64 protrude from the structural panels is minimised so that in the fully collapsed state the structural panels can sit generally flush against one another.

An enlarged view of part of the connector 60 is shown in FIG. 9 for the purposes of describing a mechanism for locking extension of the connectors when a cavity 16 of the required size is defined between the structural panels 12, 14.

The second sliding member 72 comprises two elongate slots 80. Locking pins 82 (shown prior to insertion) extend through openings 84 in the first and third sliding members 70, 74 and through respective elongate slots 80. The locking pins slide along the elongate slots when the second sliding member moves into and out of the first and third sliding members. The locking pins abut against an end of the elongate slots to limit sliding movement of the second sliding member 72 out of the first and third sliding members 70, 74.

The first and third sliding members 70, 74 each have two elongate slots 86, 88 at upper and lower portions of the members. The sockets 76, 78 have a plurality of openings 90, 92 arranged to be aligned with respective elongate slots 86, 88. Upper and lower locking pins 94, 96 (shown prior to insertion) extend through any one of the plurality of openings 90, 92 and through respective elongate slots 86, 88. The locking pins 94, 96 slide along the respective elongate slots 86, 88 when the first and third members 70, 74 slide into and out of the sockets 76, 78 and abut against an end of the respective elongate slots to limit sliding movement of the first and third members out of the sockets.

The limitation of such sliding movement is dependent on which of the openings 90, 92 receives the locking pins 94, 96. In this way, extension of the connectors can be limited to fix any one of a plurality of different distances between the first and second structural panels 12, 14 for example for forming wall structures of any one of a plurality of different thicknesses.

In a simpler arrangement, a single opening 90, 92 may be provided for limitation to a single distance between the panels. In a further alternative, a plurality of openings may be provided in place of openings 84 for allowing control of the thickness of the cavity 16. Other arrangements for limiting extension of the connectors and/or selecting the distance of extension can be provided as required. For example, the sliding members of the connectors may have a ratchet arrangement which allows relative sliding movement in one direction but resists it in an opposing direction.

The ratchet arrangement may comprise a releasable ratchet mechanism so that relative sliding movement in the opposing can be permitted when the mechanism is released but otherwise restricts movement.

When the connectors 60 are extended the second sliding member 72 is exposed within the cavity 16. In the preferred illustrated arrangement, the sliding members 72 have generally U-shaped cut-outs 98 for locating reinforcing members, such as steel bars (shown in ghost lines 100 on FIG. 7), for forming, for example, a reinforced concrete structure.

The sliding members 70, 72, 74 are preferably made from a moulded plastics material which is sufficiently strong to resist longitudinal loading when settable compound such as concrete is poured into the cavity between the structural panels.

In the examples shown, a cavity 16 is defined between the structural panels for receiving a settable compound. However, it may be required or preferable to provide a layer of insulation or additional insulation between the structural panels. In this case, the connectors may be configured to accommodate or locate a layer of insulation so that a cavity for settable compound is formed between one of the structural panels 12, 14 and a layer of insulation.

Prior to transportation, and if not moulded into the thermoplastic polymer, the connectors 60 are connected to the first and second structural panels 12, 14 and the spacing between the panels is reduced by decreasing the length of the connectors as shown in FIG. 8. The reduced spacing allows convenient transportation because the system occupies a reduced volume. Following transportation and unloading from the transportation vehicle, the system is placed in the required location and the connectors extended to provide a cavity 16 of the correct depth between the structural panels 12, 14 or between one of the structural panels and a layer of insulation.

Prior to pouring settable compound additional formwork is placed on the lateral sides of the panels 12, 14 to define an enclosed space for receiving the compound. The lateral formwork may be separate from or integrated with the structural panels 12, 14 depending on requirements. Typically, when the settable compound has cured the formwork remains in place to provide inner and outer surfaces of the structure, for example for receiving rendering on an inside of the building.

It is understood that the formwork when employed as part of a vertical structure, may define a wall of a building or other construction which possesses superior thermal properties as well as technical strength, as provided by the settable compound, such as concrete. The strength of a structure may be further enhanced by reinforcing bars or beams, for example as depicted in FIG. 7.

The invention has been described by way of several embodiments, with modifications and alternatives, but having read and understood this description, further embodiments and modifications will be apparent to those skilled in the art. All such embodiments and modifications are intended to fall within the scope of the present invention as defined in the accompanying claims.

The invention claimed is:

1. A formwork system for construction having structural panels and a plurality of connectors which when adjusted define a formwork for receiving a settable compound in a cavity defined by the structural panels, the system comprising:

first and second structural panels which in use are connected one to another by the plurality of connectors so as to define the cavity, the first and second structural panels having respective first and second panel connection formations formed therein for connection to the connectors;

the plurality of connectors each have first and second end connecting portions adapted for connection to the respective first and second panel connection formations so as to hold the first and second structural panels parallel one to another, the plurality of connectors each further having an adjustable portion that adjusts a connected distance between the first and second structural panels;

wherein the formwork system is arranged so that the first and second structural panels can be locked in a plurality of relative positions by means of the adjustable portion of each of the plurality of connectors between two extremes of movement and at one or more relative positions between the two extremes of movement, the plurality of relative positions including a reduced connected distance and an increased connected distance;

wherein the reduced connected distance is selected such that the first and second structural panels sit generally flush against one another so that there is substantially no space between the first and second structural panels; and wherein the adjustable portion includes three sliding members, the three sliding members including a first and second sliding members that are received in, and slide relative to, respective first and second end connecting portions, each of the first and second end connecting portions having an elongate slot that defines a socket for receiving a third sliding member which slides into each socket, whereby the first and second sliding members slide in a direction that is generally perpendicular to a plane of the first and second structural panels such that the first and second sliding members telescopically nest in the sockets, the third sliding member in turn telescopically nests in the first and second sliding members, thereby permitting the first and second structural panels to sit generally flush one against the other and so as to be deployable by pulling apart the first and second structural panels.

2. The formwork system as claimed in claim 1, wherein a length of the second sliding member is in the direction that is generally perpendicular to the plane of the first and second structural panels, the length of the second sliding member being less than or equal to a length in the direction of the second end connecting portion so that the respective first and second sliding members may be fully received in the sockets.

3. The formwork system as claimed in claim 1, wherein the first and second panel connection formations are fixed to respective first and second end connecting portions of the plurality of connectors during manufacture by forming the first and second panel connection formations around the first and second end connecting portions.

4. The formwork system as claimed in claim 1, wherein the first and second panel connection formations are fixed to respective first and second end connecting portions of the plurality of connectors by moulding the first and second panel connection formations around the plurality of connectors.

5. The formwork system as claimed in claim 1, wherein the sliding members have generally U-shaped cut-outs for locating reinforcing members for forming a reinforced concrete structure.

6. The formwork system as claimed in claim 1, further comprising a locking mechanism operable for resisting lengthwise extension of the adjustable portion.

7. The formwork system as claimed in claim 6, wherein the locking mechanism is selectively operable for resisting lengthwise extension of the adjustable portion beyond any one of a plurality of lengths.

8. The formwork system as claimed in claim 7, wherein the connecting portions of the plurality of connectors are configured to engage with the first and second panel connection formations of the first and second structural panels over a length or a height of the first and second structural panels when the first and second structural panels are in use.

9. The formwork system as claimed in claim 1, further comprising a locking mechanism operable for resisting lengthwise extension of the adjustable portion; wherein the locking mechanism comprises a plurality of locking pins for abutting against at least one of the sliding members of the adjusting portion for limiting relative sliding movement.

10. The formwork system as claimed in claim 1, having a transportation state in which the adjustable portions of the plurality of connectors are adjusted to minimize a spacing between the first and second structural panels and a formwork state in which the adjustable portions are adjusted to space the first and second structural panels apart from one another for defining the cavity for receiving the settable compound.

11. A structure includes the formwork system as claimed in claim 1 into which has been poured the settable compound.

12. A dwelling building includes the formwork system as claimed in claim 1 into which has been poured the settable compound.

13. A plurality of connectors for use with a formwork construction system, the connectors being adapted for use with first and second structural panels, so that when installed therein, the connectors permit adjustment of the first and second structural panels from a closed position to an open position thereby defining a cavity between the first and second structural panels for receiving a settable compound, the connectors comprising:

first and second sliding members;

first and second end connecting portions adapted for connection to respective first and second panel connection formations that are formed in the first and second structural panels for receiving the first and second end connecting portions; and an adjustable portion which has two ends each of which connects to the first and second sliding members respectively, so that in use adjustment of a distance between the first and second end connecting portions is permitted, and a lock mechanism enables the first and second sliding members and the adjustable portion to be locked in a plurality of relative positions;

wherein the first and second sliding members are received in, and slide relative to, respectively the first and second end connecting portions, each of the first and second end connecting portions having an elongate slot that defines a socket for receiving the adjustable portion which slides thereinto; and wherein the first and second sliding members slide in a direction that is generally perpendicular to a plane of the first and second structural panels such that the first and second sliding members telescopically nest in the sockets of the first and second end connecting portions, the adjustable portion in turn telescopically nests in the first and second sliding members, thereby permitting the first and second structural panels to sit generally flush one against the other in the closed position and so as to be deployable to the open position by pulling apart the first and second structural panels.

14. The plurality of connectors as claimed in claim 13, wherein the adjustable portion slides into the first and second sliding members in a telescoping manner, thereby in use permitting the cavity between the first and second structural panels to be increased or decreased.

15. The plurality of connectors as claimed in claim 13, wherein the first and second end connecting portions, the adjustable portion, and the lock mechanism are supplied in a sealed package.

16. A formwork system for construction having structural panels and a plurality of connectors which when adjusted define a formwork for receiving a settable compound in a cavity defined by the structural panels, the system comprising:

first and second structural panels which in use are connected one to another by the plurality of connectors so as to define the cavity, the first and second structural panels having respective first and second panel connection formations formed therein for connection to the connectors;

the plurality of connectors each have first and second end connecting portions adapted for connection to the respective first and second panel connection formations so as to hold the first and second structural panels parallel one to another, the plurality of connectors each further having an adjustable portion that adjusts a connected distance between the first and second structural panels;

wherein the formwork system is arranged so that the first and second structural panels can be locked in a plurality of relative positions by means of the adjustable portion of each of the plurality of connectors between two extremes of movement and at one or more relative positions between the two extremes of movement, the plurality of relative positions including a reduced connected distance and an increased connected distance;

wherein the reduced connected distance is selected such that the first and second structural panels sit generally flush against one another so that there is substantially no space between the first and second structural panels; and further comprising a third sliding member, the third sliding member being received in, and sliding relative to, the adjustable portion of each of the plurality of connectors each of the first and second end connecting portions having an elongate slot that defines a socket for receiving the third sliding member which slides into each socket.

* * * * *